United States Patent [19]

Bippus

[11] 4,212,214

[45] Jul. 15, 1980

[54] ANTI-KICKBACK DEVICE

[75] Inventor: Jacob R. Bippus, Pittsburgh, Pa.

[73] Assignee: Rockwell International Corporation, Pittsburgh, Pa.

[21] Appl. No.: 958,256

[22] Filed: Nov. 6, 1978

[51] Int. Cl.[3] ..... B27G 19/02; B27G 19/08

[52] U.S. Cl. ..... 83/102.1; 83/440.2; 83/DIG. 1

[58] Field of Search ..... 83/102.1, 440.2, 478, 83/471.3, 486.1, 422, 546, DIG. 1

[56] References Cited

U.S. PATENT DOCUMENTS

| | | | |
|---|---|---|---|
| 1,074,198 | 9/1913 | Phillips | 83/440.2 |
| 1,089,901 | 3/1914 | Carson | 83/440.2 |
| 2,095,330 | 10/1937 | Hedgpeth | 83/102.1 |
| 2,257,459 | 9/1941 | Gardner | 83/102.1 |
| 2,731,049 | 1/1956 | Akin | 83/478 |
| 2,823,711 | 2/1958 | Kaley | 83/102.1 |
| 3,656,519 | 4/1972 | Stackhouse | 83/102.1 |

*Primary Examiner*—Frank T. Yost

[57] ABSTRACT

An anti-kickback device for mounting on table saws or radial arm saws that prevents the saw from throwing the board being cut back into the operator doing the feeding. This is especially useful when ripping.

5 Claims, 4 Drawing Figures

ANTI-KICKBACK DEVICE

BACKGROUND OF THE INVENTION

This invention relates to means for preventing kickback of boards when ripping them with a circular saw. This kickback usually occurs when the piece being cut is caught by the rapidly rotating saw blade, and is propelled backwards. Various devices have been previously developed to prevent this. U.S. Pat. No. 3,232,326 shows a series of finger-like leaves of varying lengths having a gripping surface on the bottom depending from the splitter of a table saw. Radial arm saws commonly use fingers depending from an adjustable rod (for size of work) which pivot freely in the direction of feeding of the work, but are supposed to dig into the work when the direction is suddenly reversed. U.S. Pat. No. 1,074,198 shows a toothed roller journaled in inclined slots for upward movement to allow passage of the work under it. The teeth contact a rack in the housing that upon reversal of feeding direction, presumably forces the teeth down into the work. The patent is unclear how the feeding allows the toothed roller to remain in contact with the work. Another patent of interest is U.S. Pat. No. 1,089,901 which discloses an anti-kickback having a ratchet type one-way clutch. The working teeth are spring-biased into contact with the work.

U.S. Pat. No. 2,095,330 discloses an anti-kickback mounted on a splitter having a resilient rubber covering contacting the work.

Other patents of more general interest include: Nos. 2,479,998, 1,600,604 and 1,818,300 (all U.S.).

All the above are deficient in one or more ways as an anti-kickback; as mentioned above, the operation of the device of U.S. Pat. No. 1,074,198 is not clear—either the toothed roller rides up the rack and loses contact with the workpiece, or is allowed in some unexplained manner to become disengaged from the rack, in which case it would be ineffective. The U.S. Pat. No. 1,089,901 has a similar toothed roller that is free to turn in one direction and is prevented from turning in the other direction. This roller is spring-biased downwardly, and the spring force is constant for any one thickness of board. Presumably, this would leave a set of marks across the workpiece. At the same time, the effectiveness of the roller is directly dependent upon the spring.

The other patents mentioned above have similar drawbacks, necessitating the development of the instant invention.

SUMMARY OF THE INVENTION

It is an object of this invention to provide a device that is adaptable to either table saws (with the blade projecting through an opening in the table) or to radial arm saws (in which the blade is suspended above the table) to prevent kickback when ripping.

It is a further object of this invention to provide increased resistance to kickback in direct proportion to the amount of movement of the workpiece in the kickback direction.

Another object is to provide a device which is readily adjusted, and (in the case of radial arm saws) is easily moved to a position out of the way when performing other cutting operations.

DESCRIPTION OF THE PREFERRED EMBODIMENTS OF THE INVENTION

Figure 4:
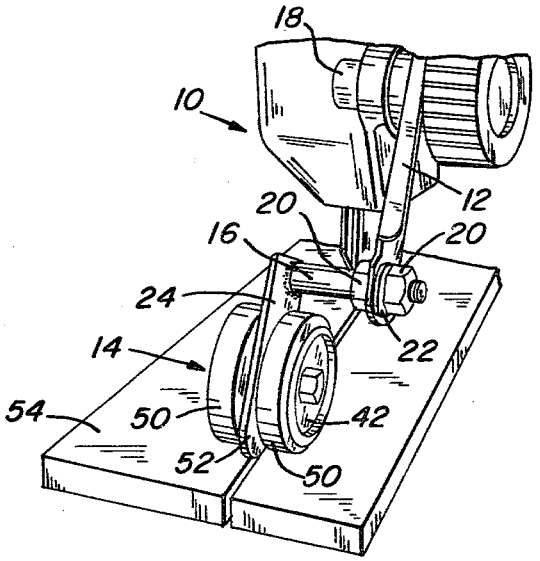
FIG. 4 shows the invention in place on a radial arm saw.

Referring first to FIG. 4, a portion of a radial arm saw 10 with a depending arm 12 for supporting an anti-kickback 14 by means of a horizontally projecting shaft 16, is shown. The depending arm 12 is vertically adjustable and swingable about a locking pivot 18, to allow proper positioning of the anti-kickback when in use, and to allow it to be swung out of the way when the saw is used for other work. Horizontal shaft 16 is also adjustable horizontally, to properly align the anti-kickback with the saw blade, by means of nuts 20 and lock washers 22 (one seen in this view).

Figure 1:
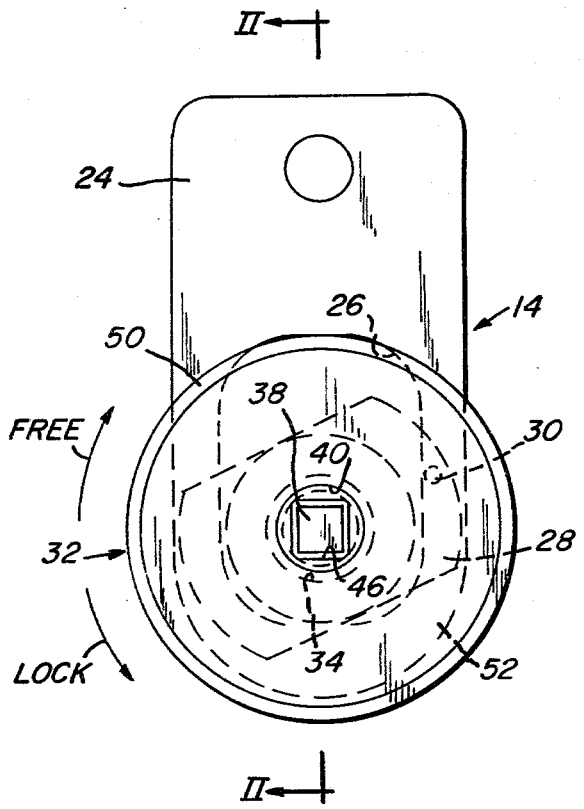
FIG. 1 is a side view of the invention.
Figure 2:
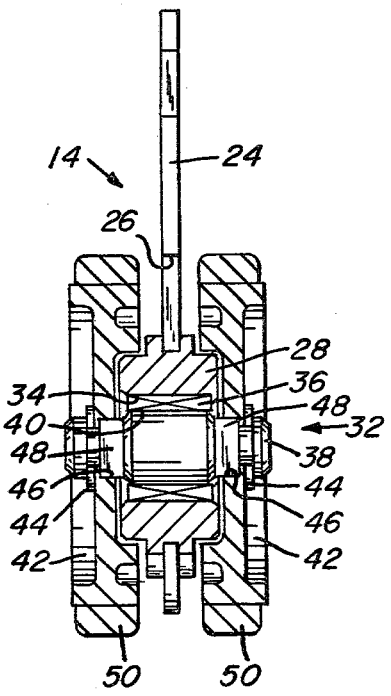
FIG. 2 is a section along line II—II of FIG. 1.

Referring to FIGS. 1 and 2 we see that anti-kickback 14 consists of a holder 24 with a slot 26 for accommodating pivotal movement of a mounting plate 28. Mounting means (or "plate") 28 rotates about a pin 30, providing upward movement of the mounting plate. A rotatable wheel assembly 32 is mounted in the bore 34 of mounting means 28. Assembly 32 comprises a one-way clutch 36, which allows rotation in the one direction only and shaft 38 mounted in the bore 40 of clutch 36, and has a roller 42 fixed on either side of the clutch and mounting means. The rollers are retained on the shaft by snap rings 44. These rollers 42 are fixed to turn with shaft 38 by any suitable means. In this instance, non-circular roller bores 46 mate with like sections 48 on shaft 38.

The periphery of each roller 42 is fitted with a work-engaging "tire" 50 bonded to it. This "tire" is preferably a material having a high coefficient of friction, but relatively resilient so that it does not mark the workpiece. The preferred material at the present time is a polyurethane having these characteristics.

In use, the anti-kickback is positioned as shown in FIG. 4. The bottom portion 52 of holder 24 is adjusted (by loosening locking pivot 18) so that it is closer to the work table than the thickness of the workpiece 54. This allows the "tongue" or bottom portion 52, to act as a splitter, keeping the cut portion of the work from binding the saw blade. When the workpiece 54 first engages the anti-kickback assembly 14, rollers 42, being free to rotate in the direction of feeding the work, rotate freely. At the same time, mounting plate 28 pivots upwardly about pin 30, allowing the workpiece to freely pass under the rollers. In the event of kickback, the "tires" of rollers 42, having a high-friction surface, stop. Any backward force applied by workpiece 54 to rollers 42, generates a downward force on the workpiece about pivot pin 30 by wheel assembly 32, increasing the holding force applied to the workpiece to prevent kickback.

Figure 3:
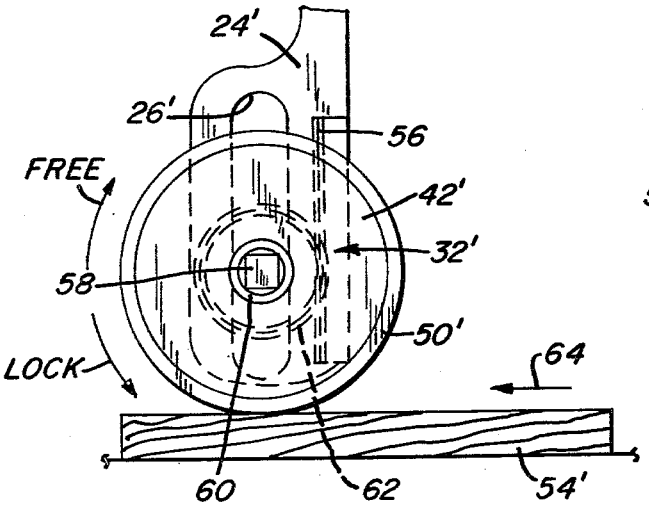
FIG. 3 is a side view of an alternate embodiment of the invention.

An alternate embodiment is shown in FIG. 3. A holder 24' has a slot 26' for mounting a wheel assembly 32'. Holder 24', however, carries a rack member 56 offset from but parallel with slot 26'. A shaft 58 carries a one-way clutch 60 (similar to clutch 36 in the other embodiment), and also mounts one or more rollers 42' each having a work-engaging "tire" 50', similar to the other embodiment. One-way clutch 60 mounts a pinion 62, which engages the rack 56. As in the other embodiment, the roller (or rollers) 42′ are mounted to rotate with shaft 58, which is free to rotate in one direction only inside clutch 60. Thus, it can be seen that workpiece 54′ can be easily moved in the feeding direction indicated by the arrow 64, rotating roller 42′ and raising shaft 58 and pinion 62 upwardly on rack 56 to allow the work to pass freely underneath. If, however, a reversal of the feeding direction occurs, the one-way clutch 60 locks and the roller 42′ and pinion 62 operates as if fixed together on the shaft 58. This produces rotation (or a force towards rotation) in the counter-clockwise direction, causing the pinion to try to roll downwardly on the rack 56, producing increased pressure of the roller 42′ on the workpiece 54′, consequently increasing the anti-kickback force on the workpiece.

While the foregoing description has been applied primarily to radial arm saws, in which the blade is positioned above the table and workpiece, it should be recognized that this anti-kickback can also be applied to the tools generally designated as table saws, wherein the motor and blade arbor are mounted beneath the table, and the blade projects through an opening in the table. In that instance, the anti-kickback may be mounted much like the finger-like leaves of U.S. Pat. No. 3,232,326 are mounted, or in any of a number of easily visualized ways.

From the above description, it can be seen that a novel anti-kickback device for mounting on saws has been developed, that provides operator safety without marking the workpiece. This device develops increased resistance to kickback with increased kickback force, and includes an integral splitter to aid in operator safety.

I claim:

1. An anti-kickback device for use with stationary saws having a work table and a saw associated with said work table, said anti-kickback device comprising, a holder, mounting means on said holder, a rotatable wheel assembly on said mounting means allowing rotation in one direction only and having a member adapted to contact the surface of a workpiece, said mounting means including a pivotal connection between said mounting means and said holder, and a slot in said holder for permitting limited rotation of said mounting means about said pivotal connection, whereby gripping force on said workpiece is increased when said wheel assembly has a force applied opposite to said one direction.

2. The device of claim 1, wherein said holder has a portion adapted for use as a splitter.

3. The device of claim 1 wherein said workpiece contacting member has a resilient surface having a high coefficient of friction.

4. An anti-kickback device for attachment to a stationary saw comprising, a holder with provision for attaching to said saw, a mounting plate pivotally mounted on said holder and movable in a slot in said holder, a one-way clutch mounted in said mounting plate, a shaft mounted in said clutch for unidirectional rotation, a roller fixed on said shaft for unidirectional rotation therewith, said roller having a work-contacting periphery with a relatively high coefficient of friction, said pivotal mounting of said mounting plate being located so that movement of said roller in the direction opposite said unidirectional rotation produces a force moment about said pivot.

5. An anti-kickback device for attachment to a stationary saw comprising, a holder with provision for attaching to said saw and having a longitudinal slot therein, a rack fixed on said holder offset from, but parallel to, said slot, a shaft mounted for movement in said slot, said shaft mounting a unidirectional clutch, a pinion mounted on said clutch and engaging said rack, said shaft also mounting a work-engaging roller, said roller being fixed to rotate with said shaft and having a non-marking work-contacting periphery.

* * * * *